US009644390B1

(12) United States Patent
Garvens et al.

(10) Patent No.: US 9,644,390 B1
(45) Date of Patent: May 9, 2017

(54) PORTABLE PERSONAL PRIVACY SCREEN

(71) Applicants: Derek Garvens, San Francisco, CA (US); Phillip H. Neal, San Rafael, CA (US)

(72) Inventors: Derek Garvens, San Francisco, CA (US); Phillip H. Neal, San Rafael, CA (US)

( * ) Notice: Subject to any disclaimer, the term of this patent is extended or adjusted under 35 U.S.C. 154(b) by 0 days.

(21) Appl. No.: 15/398,692

(22) Filed: Jan. 4, 2017

Related U.S. Application Data

(60) Provisional application No. 62/424,845, filed on Nov. 21, 2016.

(51) Int. Cl.

| | |
|---|---|
| ***E04H 15/02*** | (2006.01) |
| ***E04H 15/40*** | (2006.01) |
| ***A47C 21/00*** | (2006.01) |
| ***A47C 29/00*** | (2006.01) |

(52) U.S. Cl.
CPC ..... *E04H 15/40* (2013.01); *A47C 21/00* (2013.01); *A47C 29/003* (2013.01); *E04H 15/02* (2013.01); *E04H 15/405* (2013.01)

(58) Field of Classification Search
CPC ..... E04H 15/02; E04H 15/40; E04H 15/405; A47C 21/00; A47C 29/003
USPC ..... 135/96, 126; 5/113, 414, 418, 5/503.1–506.1, 512
See application file for complete search history.

(56) References Cited

U.S. PATENT DOCUMENTS

| | | | | | |
|---|---|---|---|---|---|
| 326,437 | A | | 9/1885 | Marsh | |
| 619,650 | A | | 2/1899 | Woodward | |
| 625,496 | A | | 5/1899 | Fischer | |
| 1,072,490 | A | * | 9/1913 | Oilar | A47C 21/024 5/505.1 |
| 1,134,009 | A | | 3/1915 | Reid | |
| 1,687,862 | A | | 10/1928 | de Sena Y Freixas | |
| 2,367,043 | A | | 1/1945 | Nelson | |
| 2,401,999 | A | * | 6/1946 | Wolfe | A47C 21/024 248/228.1 |
| 2,737,193 | A | | 3/1956 | Boyd | |
| 4,030,748 | A | | 6/1977 | Brock | |
| 4,489,451 | A | * | 12/1984 | Neely | A47C 29/003 135/121 |
| 4,825,892 | A | * | 5/1989 | Norman | E04H 15/40 135/126 |
| 4,915,120 | A | | 4/1990 | Ziolkowski | |
| 5,059,463 | A | | 10/1991 | Peters | |
| 5,613,757 | A | | 3/1997 | Polk | |
| D400,949 | S | * | 11/1998 | Gale | D21/834 |
| 5,992,045 | A | * | 11/1999 | Kellogg | F26B 25/18 160/370.21 |
| 6,145,141 | A | | 11/2000 | Whittington et al. | |

(Continued)

FOREIGN PATENT DOCUMENTS

| | | | | |
|---|---|---|---|---|
| FR | 2635136 A3 | * | 2/1990 | E04H 15/003 |
| TW | EP 1103674 A1 | * | 5/2001 | E04H 15/40 |

*Primary Examiner* — Robert Canfield
(74) *Attorney, Agent, or Firm* — Patent Law Offices Michael E. Woods; Michael E. Woods

(57) ABSTRACT

A system and method for simply and efficiently improving on personal privacy, particularly in a portable or temporary format. A system may include a flexible oblong perimeter frame closed with a covering configured to be bowed into an arch, and an arch-retaining system coupled to ends of the frame maintaining the frame.

2 Claims, 5 Drawing Sheets

(56) References Cited

U.S. PATENT DOCUMENTS 6,173,725 B1 * 1/2001 Garth ..... A47C 7/66 135/117
6,588,037 B1 * 7/2003 Eno ..... A47C 29/006 135/90
6,595,227 B2 * 7/2003 Le Gette ..... E04H 15/40 135/126
6,764,133 B2 7/2004 Osato
RE38,591 E * 9/2004 Kellogg ..... F26B 25/18 160/370.21
6,942,005 B2 * 9/2005 Le Gette ..... E04H 15/40 160/368.1
7,048,333 B2 * 5/2006 Martinez ..... E04H 15/003 135/126
7,225,822 B1 * 6/2007 Zheng ..... E04H 15/40 135/117
7,302,957 B2 * 12/2007 Ross ..... E04H 15/40 135/117
D601,358 S * 10/2009 Yu ..... D6/344
7,836,906 B2 * 11/2010 Zheng ..... A63B 9/00 135/91
2002/0195135 A1 * 12/2002 Le Gette ..... E04H 15/40 135/126
2003/0106577 A1 * 6/2003 Martinez ..... A47C 7/66 135/125
2004/0016521 A1 * 1/2004 Le Gette ..... E04H 15/40 160/368.1
2004/0139996 A1 * 7/2004 Zheng ..... E04H 15/40 135/126
2004/0139997 A1 * 7/2004 Zheng ..... E04H 15/405 135/126
2004/0255996 A1 * 12/2004 Ross ..... E04H 15/40 135/126
2008/0295247 A1 * 12/2008 Rogers ..... A47C 21/024 5/505.1
2013/0276847 A1 * 10/2013 Vulich ..... A47K 3/001 135/125
2016/0324324 A1 * 11/2016 Wilkerson Altonen E04H 15/40

* cited by examiner

PORTABLE PERSONAL PRIVACY SCREEN

CROSS REFERENCE TO RELATED APPLICATIONS

This application claims benefit of U.S. Patent Application No. 62/424,845 filed 21 Nov. 2016, the contents of which are hereby expressly incorporated by reference thereto in their entireties for all purposes.

FIELD OF THE INVENTION

The present invention relates generally to privacy systems, and more specifically, but not exclusively, to a portable personal privacy screen.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Privacy is increasingly important to many people, including young adults. What is needed is a system and method for simply and efficiently improving on personal privacy, particularly in a portable or temporary format.

BRIEF SUMMARY OF THE INVENTION

Disclosed is a system and method for simply and efficiently improving on personal privacy, particularly in a portable or temporary format. The following summary of the invention is provided to facilitate an understanding of some of the technical features related to portable personal privacy screen, and is not intended to be a full description of the present invention. A full appreciation of the various aspects of the invention can be gained by taking the entire specification, claims, drawings, and abstract as a whole. The present invention is applicable to other screens for other purposes and in some instances to less portable implementations.

An embodiment of the present invention may include a flexible oblong perimeter frame closed with a covering configured to be bowed into an arch, and an arch-retaining system coupled to ends of the frame maintaining the frame.

An embodiment of the present invention may provide that the arch-retaining system include a pair of attachment structures disposed at ends of the frame and a strap having a pair of ends, each strap end including an engagement system complementary to the attachment structures to maintain an arched flexible frame in the arched configuration. Some implementations of this embodiment may allow a user to use the portable personal privacy screen in a "stand-alone" environment, such as in front of a fireplace, camp fire or other space where the user would like to establish a personal zone.

An embodiment of the present invention may provide that the arch-retaining include retainers that cooperate with the ends of an arched flexible frame and some other structure, such as mattresses of a bed. In some cases, a pair of these retainers may partially extend under a mattress while revealing a clip or holder structure beyond lateral edges of the mattress. Each clip or holder structure cooperatively engages an end of the arched flexible retainer and maintaining it in the arched configuration, like a canopy passing overhead a portion of the top surface of the mattress. The retainers may be retrofit retainers able to be added for virtually any sleeping system, or integrated into the sleeping system. Some implementations of this embodiment may allow a user to simply and easily remove and add the privacy screen (e.g., to make the bed and then re-install or other reason for removal and re-addition).

A portable screen, including an elongate flexible closed loop perimeter frame including a planar mode and a three dimensional (3D) mode with the frame configured for repeatable transitions between the modes, the frame defining a first end, a second end spaced apart from the first end by a first distance, and a body portion disposed between the ends wherein the ends define a plane for the modes, wherein the ends and the body portion are disposed within the plane in the planar mode and separated by the first distance, and wherein the ends are disposed within the plane while the body portion is disposed out of the plane in the 3D mode with the ends spaced apart a second distance in the 3D mode wherein the second distance is less than the first distance and wherein the frame includes a biasing arrangement to apply a biasing force to automatically bias a transition from the 3D mode to the planar mode whenever the frame is transitioned to the 3D mode from the planar mode; a flexible material covering the frame; and a retainer system selectively engageable with the ends to maintain the frame in the 3D mode against the biasing force as long as the ends are engaged; wherein the frame is configured to automatically transition to the planar mode from the 3D mode whenever the retainer system disengages from at least one of the ends.

A method for producing a privacy screen, including a) transitioning an elongate flexible closed loop perimeter frame from a planar mode to a three dimensional mode, the frame including the planar mode and the three dimensional (3D) mode with the frame configured for repeatable transitions between the modes, the frame defining a first end, a second end spaced apart from the first end by a first distance, and a body portion disposed between the ends wherein the ends define a plane for the modes, wherein the ends and the body portion are disposed within the plane in the planar mode and separated by the first distance, and wherein the ends are disposed within the plane while the body portion is disposed out of the plane in the 3D mode with the ends spaced apart a second distance in the 3D mode wherein the second distance is less than the first distance and wherein the frame includes a biasing arrangement to apply a biasing force to automatically bias a transition from the 3D mode to the planar mode whenever the frame is transitioned to the 3D mode from the planar mode and including a flexible material covering the frame; and b) securing the frame in the 3D mode using a retainer system selectively engageable with the ends to maintain the frame in the 3D mode against the biasing force as long as the ends are engaged; wherein the frame is configured to automatically transition to the planar mode from the 3D mode whenever the retainer system disengages from at least one of the ends.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Figure 1:
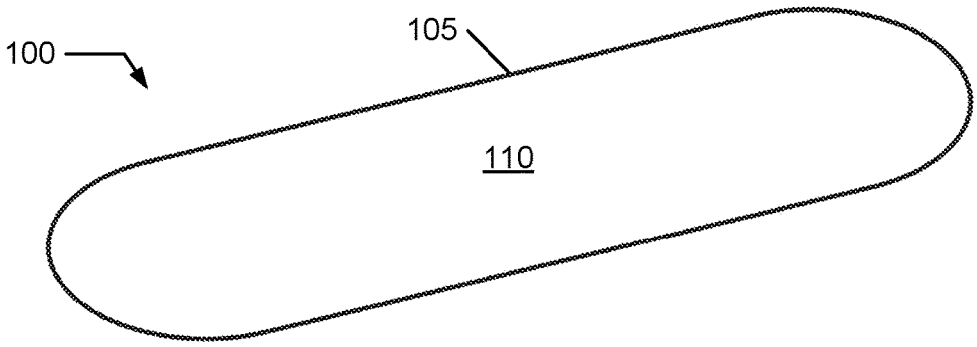
FIG. 1 illustrates an oblong flexible panel in an un-arched or flat mode.

Embodiments of the present invention provide a system and method for simply and efficiently improving on personal privacy, particularly in a portable or temporary format. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

DEFINITIONS

Unless otherwise defined, all terms (including technical and scientific terms) used herein have the same meaning as commonly understood by one of ordinary skill in the art to which this general inventive concept belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The following definitions apply to some of the aspects described with respect to some embodiments of the invention. These definitions may likewise be expanded upon herein.

As used herein, the term "or" includes "and/or" and the term "and/or" includes any and all combinations of one or more of the associated listed items. Expressions such as "at least one of," when preceding a list of elements, modify the entire list of elements and do not modify the individual elements of the list.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise. It will be understood that when an element is referred to as being "on" another element, it can be directly on the other element or intervening elements may be present therebetween. In contrast, when an element is referred to as being "directly on" another element, there are no intervening elements present.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting" refer to a direct attachment or link. Connected objects have no or no substantial intermediary object or set of objects, as the context indicates.

As used herein, the terms "couple," "coupled," and "coupling" refer to an operational connection or linking. Coupled objects can be directly connected to one another or can be indirectly connected to one another, such as via an intermediary set of objects.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

As used herein, the term "oblong" means a perimeter that is longer than it is wide. A preferred oblong perimeter is sometimes referred to as a "racetrack" defined by a pair of equal diameter semicircular discs joined to ends of a rectangle having a width equal to the diameter. Other oblong shapes may include a rectangle, oval, elliptical, or other perimeter shape. Preferably, but not required, is that the oblong have at least one axis of symmetry (e.g., a longitudinal axis extending along its length), and more preferred is to have two axes of symmetry (the longitudinal axis and a lateral axis perpendicular to the longitudinal axis extending across its width).

Figure 2:
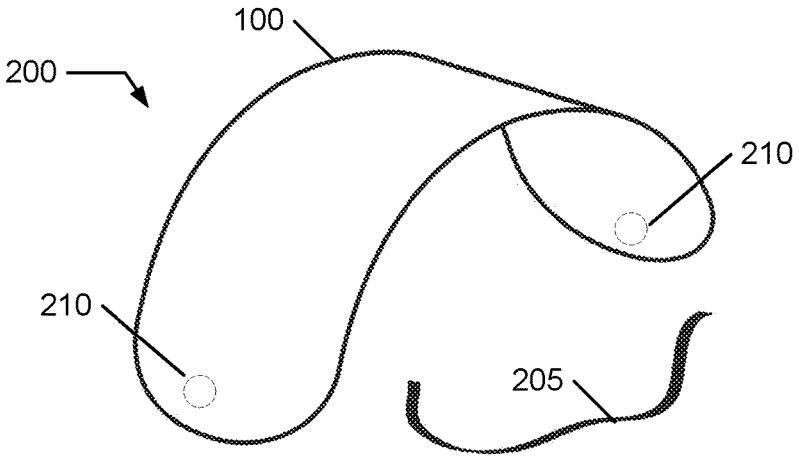
FIG. 2 illustrates components of an embodiment of a portable personal privacy system with the oblong flexible panel of FIG. 1 in an intermediate mode, which may be transitioning to or from the un-arched mode.
Figure 3:
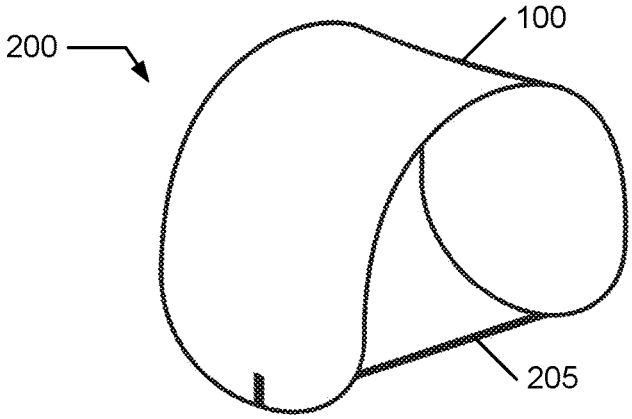
FIG. 3 illustrates configuration of the embodiment the portable personal privacy system illustrated in FIG. 2 into a freestanding portable personal privacy screen with the oblong flexible panel in an arched or folded ("taco") mode and retained by a strap coupled to opposing ends of the arched panel.

FIG. 1 illustrates an oblong flexible panel 100 in an un-arched or flat mode, FIG. 2 illustrates components of an embodiment of a portable personal privacy screen system 200 with oblong flexible panel 100 in an intermediate mode, which may be transitioning to or from the un-arched mode, and FIG. 3 illustrates configuration of portable personal privacy screen system 200 into a freestanding portable personal privacy screen with oblong flexible panel 100 in an arched or folded ("taco") mode and retained by a strap 205 coupled to opposing ends of arched panel 100.

Panel 100 includes a frame 105 defining a hollow oblong perimeter. A covering 110 engages frame 105 and fills the hollow. The type of material used for frame 105 and covering 110 is variable but share the requirement that they be flexible and allow panel to be transitioned between the flat and arched modes. For example, frame 105 may include spring steel or fiberglass that will not experience plastic deformation when panel 100 is transitioned to the arched mode of FIG. 3. Additionally, frame 105 preferably is stiff enough to quickly transition back to the flat mode from the arched mode when the restraining system is released.

Similarly, covering 110 may include a wide variety of material as long as it has minimal if any influence on panel 100 transitioning between modes. For example, in some implementations, covering 110 may include tear-resistant polyester or other material that may be made transparent, semi-transparent, translucent, and opaque. A film, fabric, netting, or other material may be used. Preferably the material resists tearing and puncture or is easily replaced or repaired.

In some implementations, covering 110 may be capable of supporting one or more patterns one or more of its surfaces (e.g., an obverse and a reverse or a front side and a back side, or the like). In some implementations, that pattern may be visible on one or both sides. For example, covering 110 that is semi-transparent may support a pattern visible when viewing either surface of panel 100. Covering 110 that is opaque may support different patterns on its two surfaces.

Panel 100, as illustrated, may be arched in either of two directions. As shown in FIG. 1, one direction includes moving ends of frame 105 "down" relative to moving a center portion "up"—this direction is further illustrated in FIG. 2 and FIG. 3. Panel 100 may in some cases also be arched in an opposite manner by transitioning the ends "up" relative to a motion of the center portion "down." With covering 110 opaque, the user may determine which pattern is visible to which sets of viewers (e.g., a first set of viewers inside a privacy zone defined by the constructed portable personal privacy screen and another set of viewers outside this privacy zone).

Strap 205 cooperates with an attachment system 210 disposed at opposite ends of panel 100. The attachment system may include a buckle, a quick-release buckle, a snap, a tie down, a pin, or the like. Strap 205 includes a complementary coupler at each end that cooperates with attachment system 210 to releasably secure and retain panel 100 in the arched mode. In some implementations, a distance between the complementary couplers may be varied, which influences a degree of arching. That is, the longer this distance, the shallower is the arch. A steepest arch may be obtained when the ends of panel 100 in the arched mode are approximately perpendicular to strap 205.

Another factor influencing the degree of arching is a length of panel 100, which in turn is informed by a set of design goals which may include an age of a person intended for its use. An important dimension is a separation distance between ends of panel 100 in the arched mode. For many implementations, that distance should enable one or two intended users to comfortably lie side-by-side between the spaced-apart and retained ends of arched panel 100.

Figure 4:
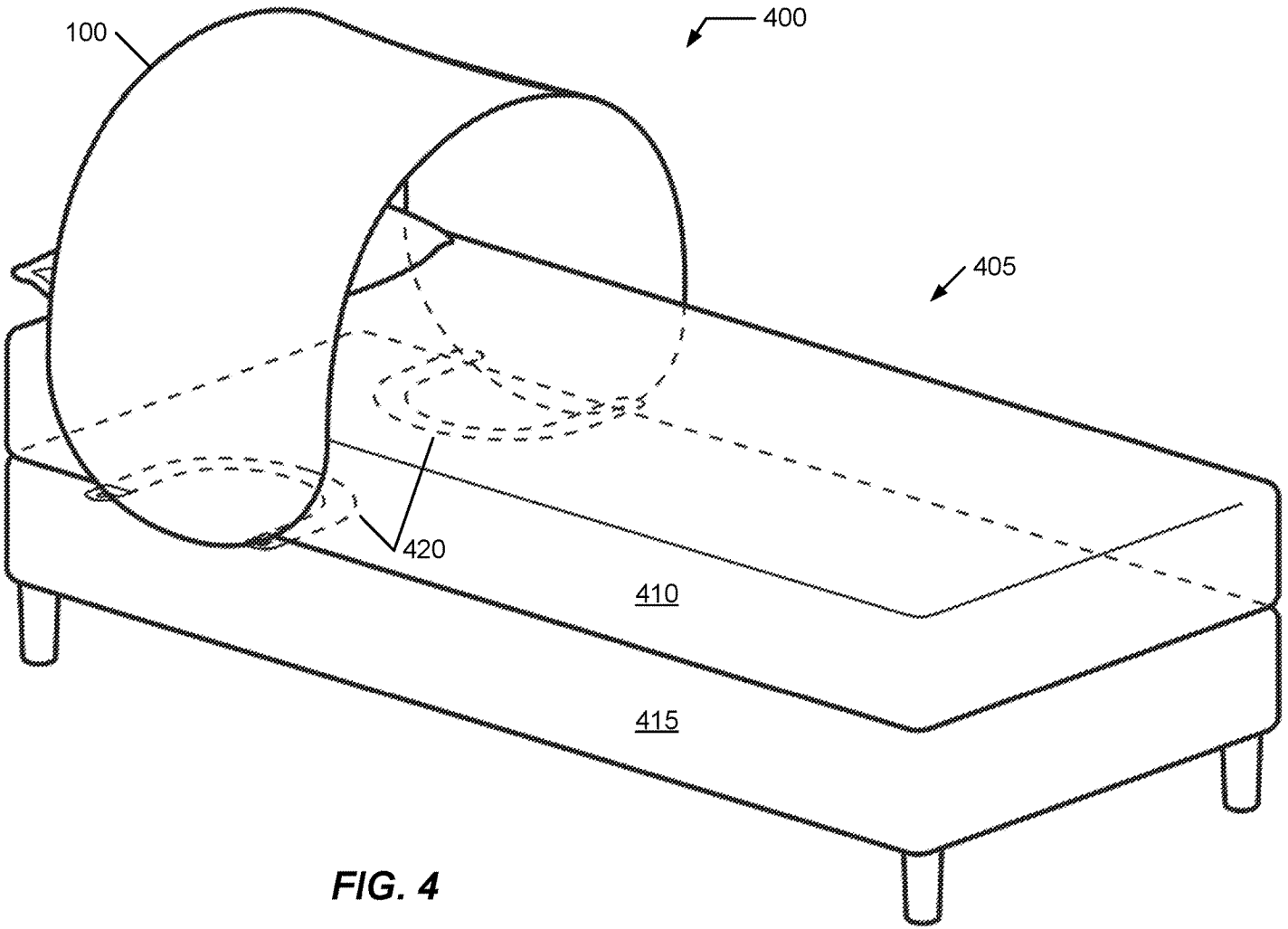
FIG. 4 illustrates an alternative embodiment for the portable personal privacy screen cooperatively configured using a sleeping system.
Figure 5:
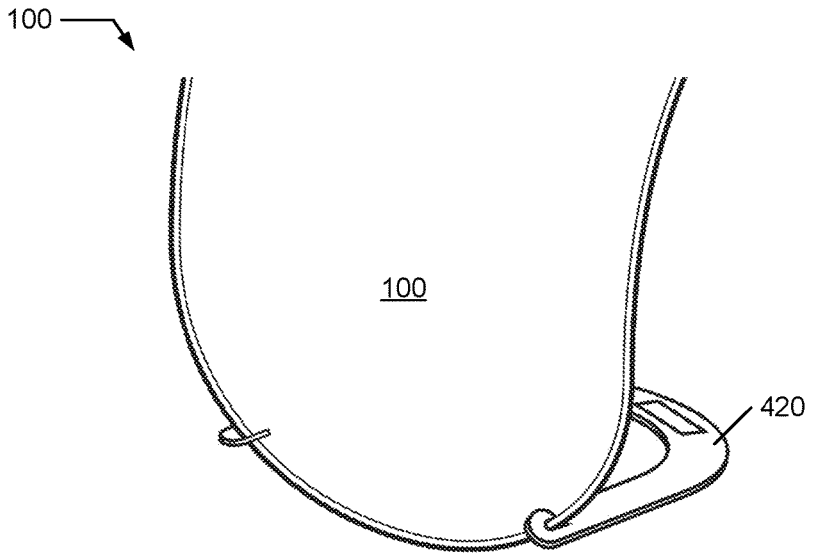
FIG. 5 illustrates a close-up of a retainer engaging an end of the flexible panel illustrated in FIG. 4.
Figure 6:
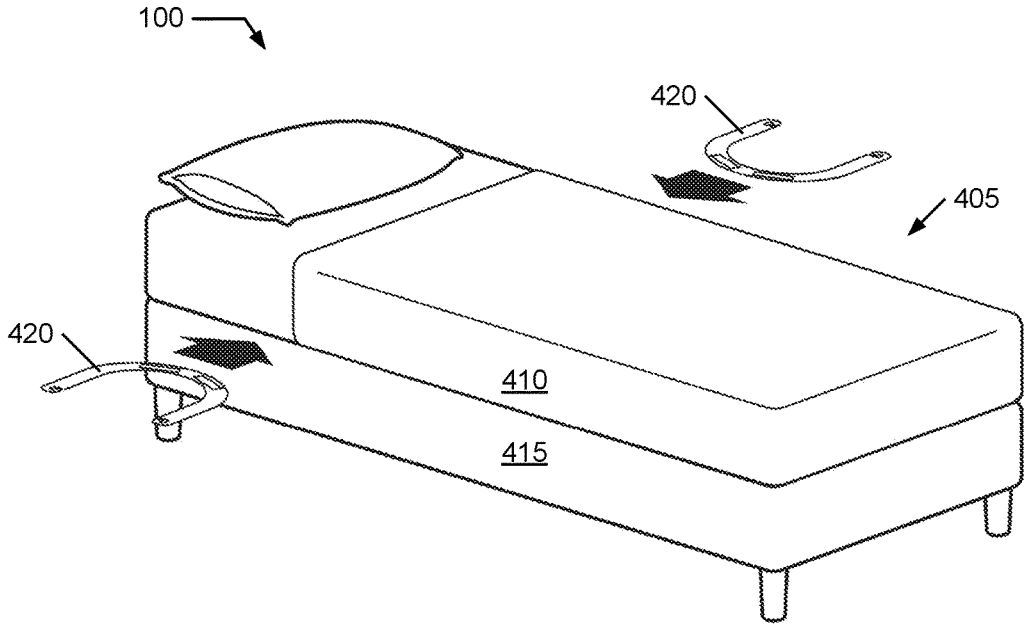
FIG. 6 illustrates installation of the retainers with the sleeping system.

FIG. 4 illustrates an alternative embodiment for a portable personal privacy screen system 400 cooperatively configured using a sleeping system 405. Sleeping system at a minimum includes a sleep support 410 (e.g., a mattress) supported by a foundation 415 (e.g., a box spring). System 400 includes panel 100 and a retention system 420. In this case, use of a strap for retention system 420, while possible, would be unwieldly, therefore retention system includes a pair of retainers disposed between sleep support 410 and foundation 415. Each retainer 420 includes an engagement structure to capture and secure an end of panel 100 in the arched mode. FIG. 5 illustrates a close-up 500 of retainer 420 engaging an end of flexible panel 100. FIG. 6 illustrates installation of a pair of retainers 420 between sleep support 410 and foundation 415.

Figure 8:
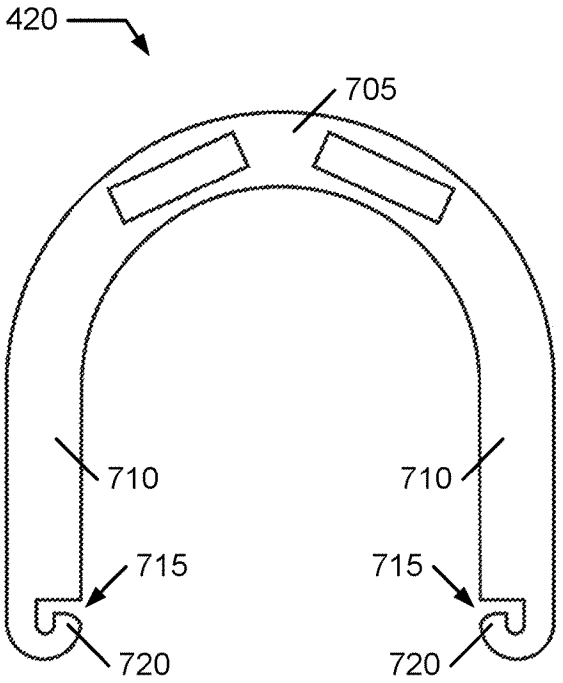
FIG. 8 illustrates a top view of the retainer.
Figure 7:
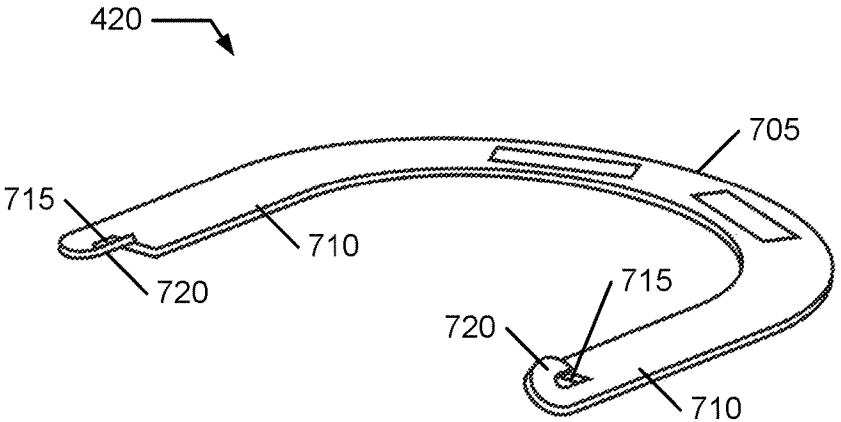
FIG. 7 illustrates a perspective view of the retainer.
Figure 9:
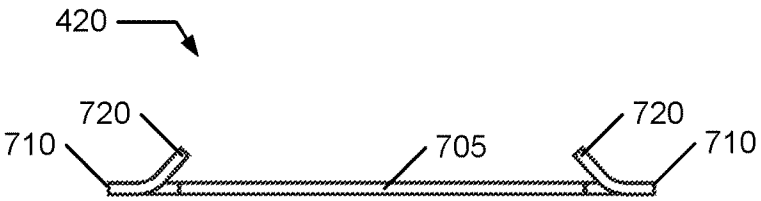
FIG. 9 illustrates an end view of the retainer.

FIG. 7 illustrates a perspective view of retainer 420, FIG. 8 illustrates a top view of retainer 420, and FIG. 9 illustrates an end view of retainer 420. Retainer 420 may be configured as a U-shaped body 705 having a pair of free ends 710. At each end 710, a notch 715 and a hook 720 selectively and releasably engage ends of panel 100.

Figure 11:
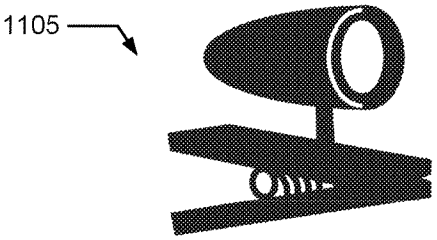
FIG. 11 illustrates a portable lighting system as an example of a type of environment-influencing devices.
Figure 10:
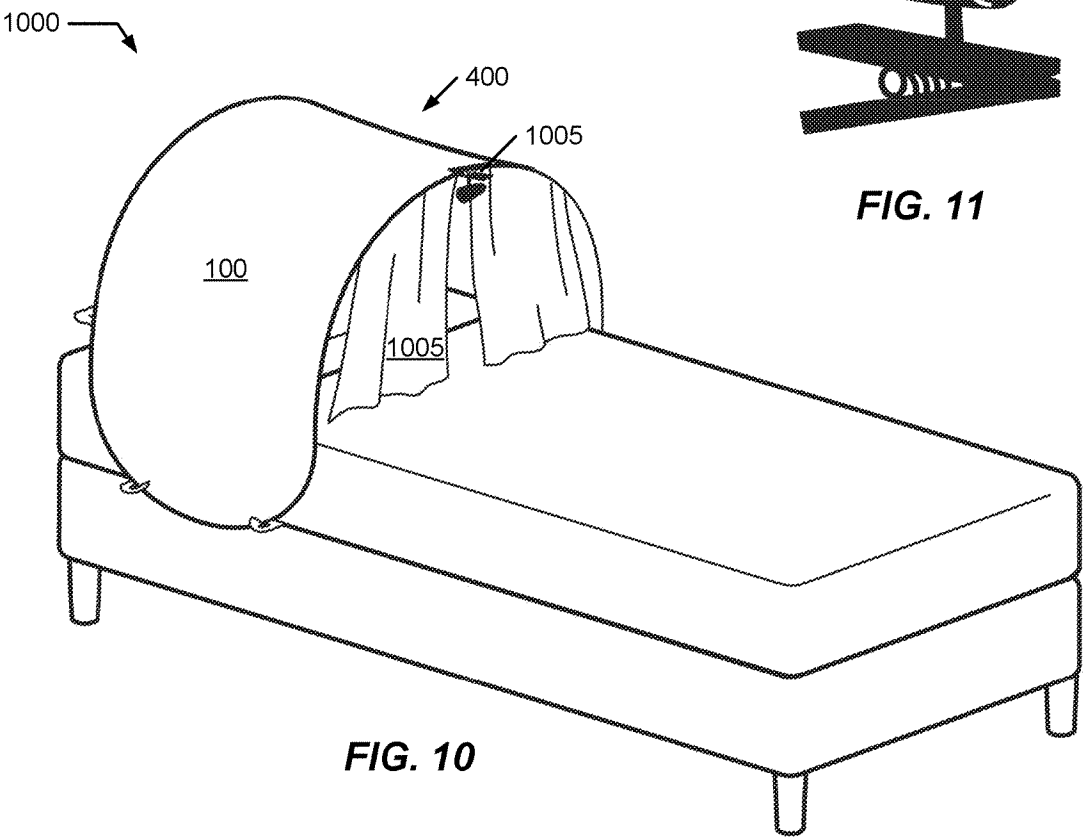
FIG. 10 illustrates an enhanced portable personal privacy screen including one or more environment-influencing devices for use with a constructed portable personal privacy screen.

FIG. 10 illustrates an enhanced portable personal privacy screen system 1000 using system 400 as a base and further including one or more optional environment-influencing devices 1005 for use with an arched and retained panel 100. As illustrated, devices 1005 may include one or more curtains at a central lateral edge of arched panel 100 and/or a portable adjustable light that may clip on the central lateral edge. FIG. 11 illustrates a portable lighting system 1105 as an example of a type of environment-influencing devices. Other implementations may include additional or alternative devices, such as a sound or ambient noise device, a charging station for personal portable electronic devices, graphic display space, glow in the dark graphics (e.g., ultraviolet-responsive ink(s) or material(s)), a storage pouch such as for books, and the like. The glow in the dark may be implemented using luminescence, preferably fluorescence, and more preferably phosphorescence, examples of selectively-visible cold body radiation (e.g., provision of visible light without heating). In this context, the structure is selectively visible in that the illumination provided is not visible when a room or environment of the screen is illuminated (naturally or artificially). As the illumination dims, the glow in the dark structure becomes more visible but is not typically visible in fully illuminated environments. Some implementations may include structures having chemiluminescence in addition to or in lieu of the fluorescence or phosphorescence.

The system and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Combinations of components or steps will also be considered as being noted, where terminology is foreseen as rendering the ability to separate or combine is unclear.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A portable screen for cooperation with a sleep support disposed on a foundation with the sleep support having a width, comprising:

an elongate flexible closed loop perimeter frame including a planar mode and a three dimensional mode with said frame configured for repeatable transitions between said modes, said frame defining a first end, a second end spaced apart from said first end by a first distance, and a body portion disposed between said ends wherein said ends define a plane for said modes, wherein said ends and said body portion are disposed within said plane in said planar mode and separated by said first distance, and wherein said ends are disposed within said plane while said body portion is disposed out of said plane in said three dimensional mode with said ends spaced apart a second distance in said three dimensional mode wherein said second distance is less than said first distance and wherein said frame includes a biasing arrangement to apply a biasing force to automatically bias a transition from said three dimensional mode to said planar mode whenever said frame is transitioned to said three dimensional mode from said planar mode;

a flexible material covering said frame; and a retainer system selectively engageable with said ends to maintain said frame in said three dimensional mode against said biasing force as long as said ends are engaged;

wherein said frame is configured to automatically transition to said planar mode from said three dimensional mode whenever said retainer system disengages from at least one of said ends;

wherein said first distance is greater than the width of the sleep support; and wherein said retainer system includes a pair of retainer clips laterally disposed between the sleep support and the foundation with each said retainer clip configured to secure one of said ends when said frame has been transitioned to said three dimensional mode.

2. A portable screen for cooperation with a sleep support disposed on a foundation with the sleep support having a width, comprising:

an elongate flexible closed loop perimeter frame including a planar mode and a three dimensional mode with said frame configured for repeatable transitions between said modes, said frame defining a first end, a second end spaced apart from said first end by a first distance, and a body portion disposed between said ends wherein said ends define a plane for said modes, wherein said ends and said body portion are disposed within said plane in said planar mode and separated by said first distance, and wherein said ends are disposed within said plane while said body portion is disposed out of said plane in said three dimensional mode with said ends spaced apart a second distance in said three dimensional mode wherein said second distance is less than said first distance and wherein said frame includes a biasing arrangement to apply a biasing force to automatically bias a transition from said three dimensional mode to said planar mode whenever said frame is transitioned to said three dimensional mode from said planar mode;

a flexible material covering said frame; and a retainer system selectively engageable with said ends to maintain said frame in said three dimensional mode against said biasing force as long as said ends are engaged;

wherein said frame is configured to automatically transition to said planar mode from said three dimensional mode whenever said retainer system disengages from at least one of said ends;

wherein said three dimensional mode includes an arch in said body portion;

wherein said first distance is greater than the width of the sleep support; and wherein said retainer system includes a pair of retainer clips laterally disposed between the sleep support and the foundation with each said retainer clip configured to secure one of said ends when said frame has been transitioned to said three dimensional mode.

* * * * *